United States Patent [19]

Klein

[11] 4,215,792

[45] Aug. 5, 1980

[54] PUSH-DOWN GATE IN A RAISED APERTURE IN A CAN END

[76] Inventor: Gerald B. Klein, 13451 Stuart Ct., Broomfield, Colo. 80020

[21] Appl. No.: 63,793

[22] Filed: Aug. 6, 1979

[51] Int. Cl.[2] ..... B65D 41/32

[52] U.S. Cl. ..... 220/268

[58] Field of Search ..... 220/266–273

[56] References Cited

U.S. PATENT DOCUMENTS

| | | | |
|---|---|---|---|
| 4,125,204 | 11/1978 | Klein | 220/268 |
| 4,126,244 | 11/1978 | Elser | 220/268 |

*Primary Examiner*—George T. Hall

*Attorney, Agent, or Firm*—Dennis O. Kraft

[57] ABSTRACT

A push-down gate in a panel section of a can end, below an aperture therein and being connected to the panel at the aperture by a hinge means wherein: said aperture comprises a short, inwardly-inclined lip upstanding from the end panel section, having an outer wall portion upfolded from the end panel, an inner wall portion forming the aperture orifice and a reverse fold at the crest of the lip interconnecting the inner and outer wall portions; an inward fold about the base of the inner wall portion forms a gate panel below the aperture, said inward fold being on a short radius and being adjacent to the upfold radius from the end panel to the outer wall portion; and a score cut in the gate panel at the inward fold extending about the panel from each side of the hinge means defines the push-down gate.

10 Claims, 16 Drawing Figures

PUSH-DOWN GATE IN A RAISED APERTURE IN A CAN END

The present invention relates to openings or gates in beverage can ends and more particularly to push-down gates which are hinged to the end.

When cans became popular for containing beverages openers were needed; subsequently opening tabs were provided in the can ends and the common ring-pull tab became very popular. The tab, pulled away from the can end was a small curled piece of metal with very sharp edges and was a definite hazard. To counter this, push-down tabs or gates were introduced. The idea was to hinge the gate to the end and to push the gate into the can at an out-of-the-way location when the can was opened. Exemplary of push-down gates is the triple-fold gate disclosed in U.S. Pat. No. 3,334,795 issued to myself and Kenneth E. Harper. Other types of gated can ends are also available and the general basic construction of any gated can end is to provide a gate which is slightly larger than and underlies an opening or aperture in the can end. The gate, hinged to the can end at an edge portion of the opening remains attached to the end when pushed downwardly into the can to open it.

Several problems have been encountered in the manufacture of gated can ends. The triple-fold gate is difficult to draw and form although it is integral with the can end and does not require attachments; also, it does not have sharp edges at the aperture. Other types of push-down gates are formed by punching out and offsetting a blank immediately below the surface of the end and then enlarging it by a coining operation. The sharp edges in the aperture of this type of push-down gate are objectionable. Also the coining operation is difficult and not entirely reliable when it is realized that large numbers of can ends must be provided which do not leak.

The present invention was conceived and developed with such other considerations in view. The invention comprises in essence, the formation of a short upstanding lip in the can end to define the opening, or aperture, and a push-down gate underneath this lip. The lip is tipped inwardly to hold the gate in place against upward movement. In a standard can end, this lip can be of a height which is approximately a curl thickness less the metal thickness to permit stacking and nesting as with conventional end units. An aperture lip height of approximately 0.085-inch will be a suitable maximum. The gate, integral with the can end, is separated therefrom by a score cut at the edge of the panel forming the gate. The outward edge of the cut is folded tightly against the bottom of the lip to eliminate sharp edges in the aperture.

It follows that the objects of the invention are to provide a novel and improved push-down lipped gate in a can end which: (a) permits a beverage to be poured from the can with a smooth jet-like flow when the gate is opened; (b) has no sharp edges in the aperture when the gate is opened; (c) requires no additional components when formed in a can end; (d) may be easily formed and drawn and (e) is an economical, reliable, neat-appearing unit.

With the foregoing and other objects in view, all of which more fully hereinafter appear, my invention comprises certain constructions, combinations and arrangements of parts and elements as hereinafter described, defined in the appended claims and illustrated in the accompanying drawing in which:

Figure 1:
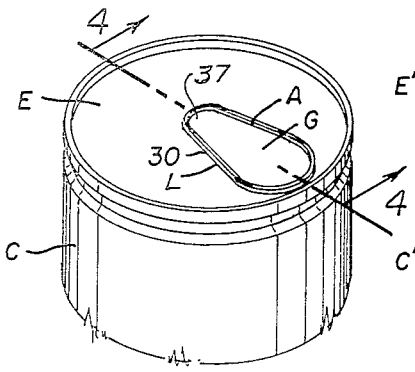
FIG. 1 is an isometric view of the upper portion of a can having a flat end with an elongated, push-down gate formed according to the present invention.
Figure 2:
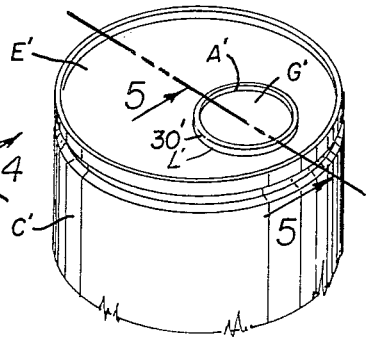
FIG. 2 is an isometric view similar to FIG. 1 but having an end with a circular gate.
Figure 3:
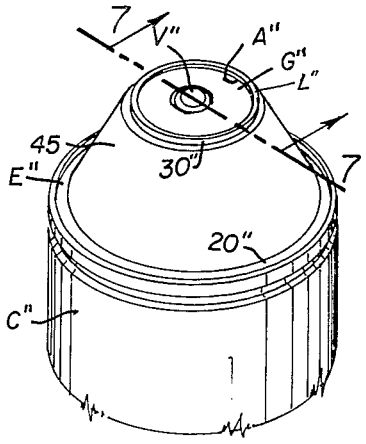
FIG. 3 is an isometric view of the upper portion of a can having a frusto-conical end with a circular push-down gate at the apex thereof.

Referring more particularly to the drawing, the can C of FIG. 1 is closed by a flat panel end E having an elongated aperture A formed by a lip L and a gate G beneath the lip. The can C′ of FIG. 2 is closed by a flat panel end E′ having a circular aperture A′ formed by lip L′ and a gate G′ beneath the lip. The can C″ of FIG. 3 is closed by a conical end E″ having a circular aperture A″ formed by lip L″ at its apex end and a gate G″ beneath the lip. A vent V″ is shown in this gate, and such is optional in any of the gates.

Figure 4:
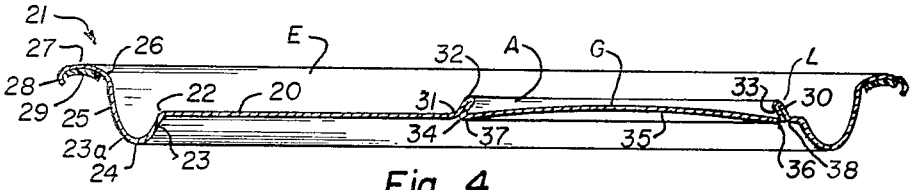
FIG. 4 is a sectional view of a can end as taken from the indicated line 4—4 at FIG. 1 but on an enlarged scale and showing the end before it is seamed onto the body of the can.

Certain conventional features of these can ends E, E′ and E″ are similar and such features relate to the structure provided for seaming the circular end to a cylindrical can wall. FIG. 4, illustrating the end E before it is seamed to a cylindrical can wall is typical. The end E includes a flat, circular expansion panel 20, and peripheral seaming and strengthening radii 21 circumscribing the panel 20. The peripheral radii 21 includes a short, downturned expansion radius 22 which turns to a chuck panel radius 23 having its bottom forming a chuck panel 24. An outward chuck panel radius **23*a* turns to an upwardly extended chuck wall 25. The upper crest of this chuck wall turns to a seaming panel radius 26 from whence a circular seaming panel 27 outstands, with the outward edge of the seaming panel being downturned to form a curl 28. A latex seaming compound 29 is provided at the inner-under portion of the seaming panel 27 to complete the connective circular edge 21. The formation of this circular edge 21** is conventional and need not be described further.

Figure 8:
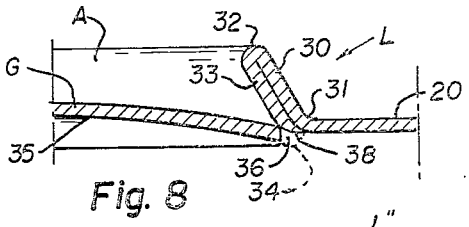
FIG. 8 is a fragmentary sectional view showing a portion of the gate and aperture structure as illustrated at FIG. 4 but on a greatly enlarged scale.

The elongated aperture A and the gate G, shown at FIGS. 1, 4, and 8, is formed by a drawing and scoring operation in the expansion panel 20. The aperture A in the flat expansion panel 20 includes a short, upstanding, inwardly-sloping lip L having an outer wall 30 which turns upwardly from the expansion panel 20 at a short radius 31. The inward slope of the lip may be varied from a few degrees from the normal to the end surface to approximately 30 degrees as illustrated, or to as much as 45 degrees, or more, such being optional. The function of the inslope is to hold the gate in place against upward movement.

This lip is topped by a 180? crest fold 32 with the metal within the lip forming an inner orifice wall 33. The base of the orifice wall 33, at the level of the expansion panel 20 is turned, as a radius 34 to form a gate panel 35. In FIG. 4 this gate panel 35 is shown as being dished or convexed upwardly but such is optional and the gate panel may also be dished or concaved downwardly or remain flat.

A score 36 is cut at the radius 34 to define the push-down gate G in the panel 35. The score cut 36 extends continuously about the gate panel 35 except at a short hinge section 37. It is to be noted that the aperture lip L may be eliminated at this hinge section 37. Also, the hinge, shown at FIG. 1 at the center of the end, may be located elsewhere as adjacent to the edge of the end. It may also be a wide hinge as in the manner disclosed in my U.S. Pat. No. 3,951,298.

The score cut 36, at the radius 34, forms a sharp-edged rim 38 at the base of the orifice wall 33. This sharp rim 38 is turned outwardly and upwardly to lie tightly against the radius turn 31 of the outer lip wall 30, as illustrated at FIG. 8. In this out-of-the-way position, the aperture wall is smooth and will not create a hazard should an individual push his finger into the opening.

To complete this end, the score 36, preferably cut through the metal, is sealed from leaking as by use of a paraffin base, hot melt adhesive or a platisol such as disclosed in U.S. Pat. Nos. 3,905,513 and 3,980,200. So sealed and with the orifice wall 33 being inclined inwardly, the gate G will not move upwardly under the pressures normally encountered in a carbonated beverage can, even though pressure causes the gate to dome, that is, to flex upwardly.

Figure 5:
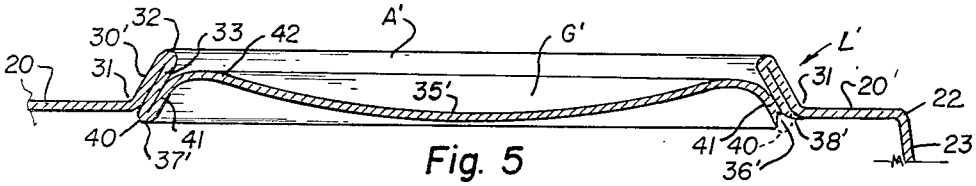
FIG. 5 is a fragmentary sectional view of the gate portion of an end as taken from the indicated line 5—5 at FIG. 2 but on an enlarged scale.
Figure 6:
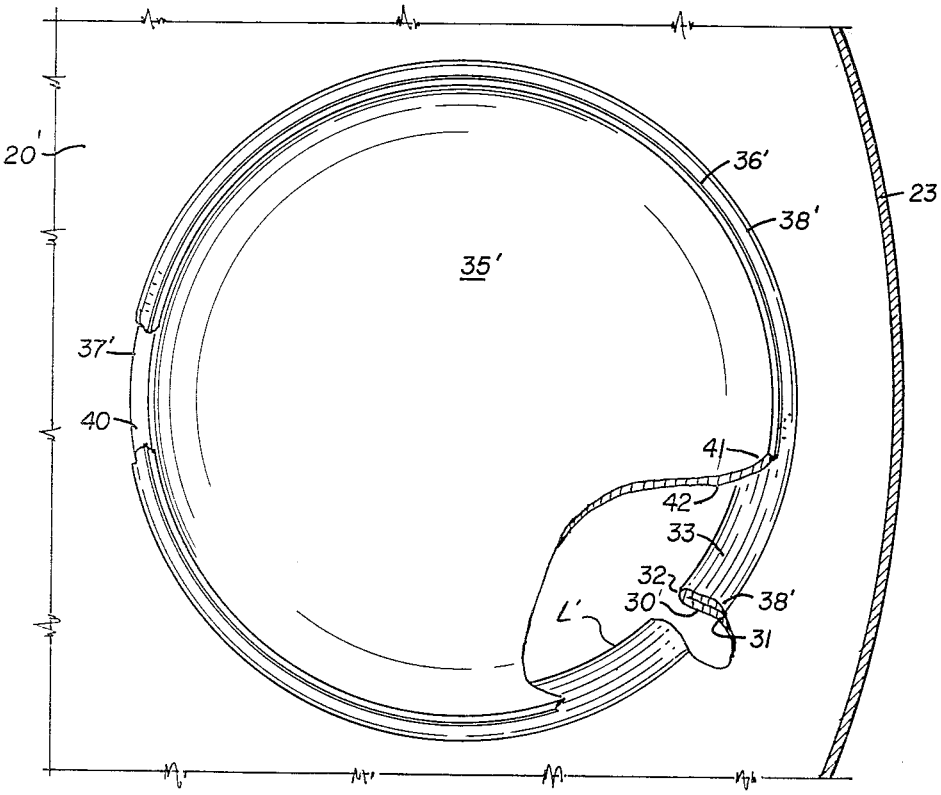
FIG. 6 is a fragmentary sectional view of the underside of the end portion shown at FIG. 5 with portions broken away to show constructions otherwise hidden from view.
Figure 9:
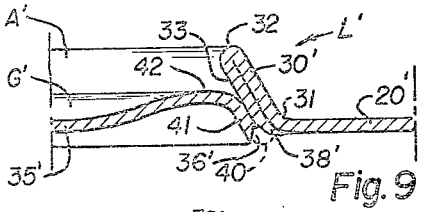
FIG. 9 is a fragmentary sectional view showing a portion of the gate and aperture structure as illustrated at FIG. 5, but on a further enlarged scale.

The circular aperture A′ and gate G′ shown at FIGS. 2, 5, 6 and 9 show a first modified construction of the improved push-down gate. The aperture A′ in the flat expansion panel 20′ includes an upstanding, inwardly-sloping lip L′ having an outer wall 30′ turning upwardly from a short radius 31 at the panel 20′. A 180° crest fold 32 joins the outer wall 30 with an inner orifice wall 33 as heretofore described. However, the base of the orifice wall 33 is terminated as a 180° return fold 40, to provide a short upsloped rim 41 at the edge of the gate panel 35′. The gate panel 35′ is dished or concaved by a reverse edge turn 42, at the edge of the rim 41, and is shown as a downwardly concaved portion within the embrace of the edge turn 42. The gate G′ is formed in the panel 35′ by a score cut 36′ at the return fold 40 and the score cut 36′ extends continuously about the gate panel 35′ except at a short hinge section 37′ best shown at FIG. 6. With the score cut 36 cut at the return fold 40, a sharp edged rim 38′ is formed at the base of the orifice wall 33. This sharp rim 38′ is turned outwardly and upwardly to lie tightly against the radius turn 31 as illustrated at FIGS. 5 and 9.

This end will be completed by sealing the score cut 36′ with a paraffin base, hot melt adhesive or plastisol as heretofore mentioned. It is to be noted that in forming the panel return fold and upsloped rim 41, the rim will fit snugly against the inwardly inclined orifice wall 33 so that there can be no upward movement of the gate **35*a***.

Figure 7:
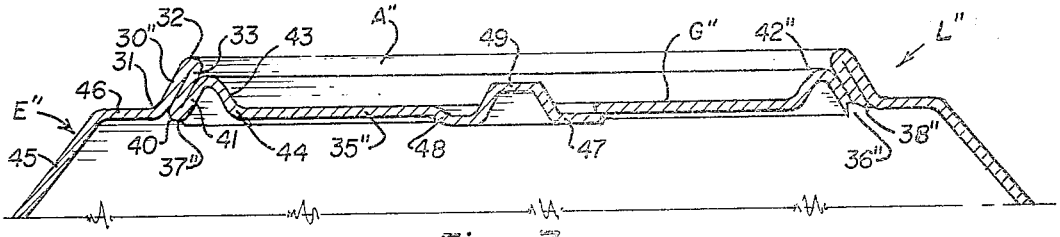
FIG. 7 is a fragmentary sectional view of the gate portion of an end as taken from the indicated line 7—7 at FIG. 3 but on an enlarged scale.

The circular aperture A″ and gate G″ shown at FIGS. 3 and 7 shows a second modified construction of the improved push-down gate where it is used in a conical end E″. The end E″ may include a short ring-like portion of an expansion panel 20″ wherein the frustum of a cone 45 is drawn. The gate G″ is at the flat apex end 46 of the cone 45. An upstanding inner sloping lip L″ has an outer wall 30″, turning upwardly from the end 46 at a short radius 31. The lip L″ is topped by a 180° crest fold 32 to turn from the outer wall 30″ an inner orifice wall 33 as heretofore described. The base of the orifice wall is terminated as a 180° return fold 40 with a short upsloped rim 41 at the edge of a panel 35″. The upper edge of the rim 41 turns as a sharp radius overfold 42″ to form a finger grip or guard ridge 43 while the central portion of the gate panel 35″ is flat with a radius turn 44 between the ridge 43 and the panel 35″.

The gate G″ is formed in the panel 35″ by a score cut 36″ at the return fold 40 and is extended continuously about the gate panel 35″ except at a short hinge section 37″. The score cut 36″ produces a sharp edged rim 38″ at the base of the aperture wall 33 which is turned to lie tightly against the radius turn 31 as heretofore described. It is sealed as heretofore described.

The vent gate V″ in the primary gate G″ is preferably, but not necessarily, at the center of the circular gate G″. This vent may be formed in several ways, such as by punching out a circular blank 47 to sever the blank from the gate panel 35″ except at a short offset hinge point 48. This permits the blank 47 to be positioned below the vent orifice in the gate. The blank is squeezed, as by coining, to enlarge its diameter. At the same time, a dome 49 is drawn in the center of the blank 47 to extend through the gate panel 35″ to be easily reached and opened by finger pressure.

Figure 10:
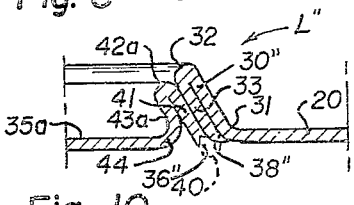
FIGS. 10 and 11 are fragmentary sectional views similar to FIGS. 8 and 9 but showing other modes of forming the gate and aperture structure.

The construction illustrated at FIG. 10 is essentially the same as that shown at FIGS. 3 and 7. The gate structure, which may be in a flat expansion panel 20, as well as at the apex end of a cone will include the sloping lip L″ with an outer wall 30″ inclined from a radius 31, with a crestfold 32 to an inner orifice wall 33 as heretofore described. The base of the orifice wall 33 terminates as a 180° return fold 40 to the rim 41 as described. The score cut 36″ about the return fold 40, except at the hinge section 37″ and the folded edge rim 38″ is the same as described. However, this third modified construction provides for a 180° overfold **42*a* at the upper edge of a rim 41 to provide for a tightly fitted finger grip or guard rim 43*a* with a sharp reverse curve 44 merging the rim 43*a* into the gate panel 35*a***.

Figure 11:
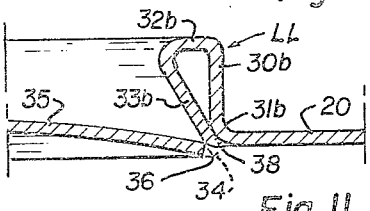

The construction illustrated at FIG. 11 is similar to that at FIG. 8 and the components and parts are the same. The lip LL is piped, however, as by pressure of a special die to enlarge this lip structure. This is desirable because the can ends are made of a very thin metal. Thus, when the lip is formed by the folding together the outer wall portion 30 and inner portion 33, as previously described, the lip may appear as a sharp edge even though the overfold 32 is rounded. The piping assures a user that the same is smooth and round with no sharp edges. The lip LL is more nearly vertical with a sharper radius 31*b* merging the wall 30*b* with the expansion panel 20. The crestfold 32*b* is widened to cause the inner orifice wall 33*b* to tip inwardly as heretofore described. The base of this orifice wall is turned at a radius 34 to form a gate panel 35. A score cut 36, and a hinge 37 are provided and the edge rim 38 of the cut is folded against the radius 31*b* as heretofore described.

Figure 12:
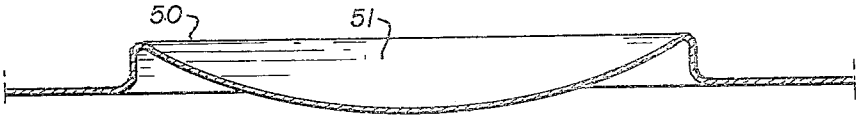
FIGS. 12, 13 and 14 are diagramatic sectional views showing selected steps in the formation of an aperture and a gate in a metal sheet.
Figure 13:
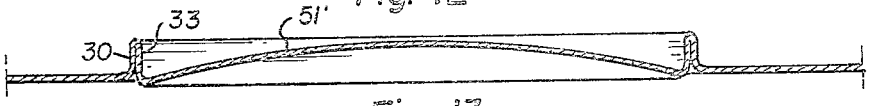

The manner in which this improved push-down gate is formed is by a sequence of conventional drawing steps. FIG. 12 shows one of the first draws where a hat section 50 is formed in a sheet of metal. The panel 51 in this hat section is concaved downwardly to prepare the metal for a subsequent draw. FIG. 13 shows the lip 30 and aperture will 33 is being formed. The panel 51' is now convexed upwardly.

Figure 14:
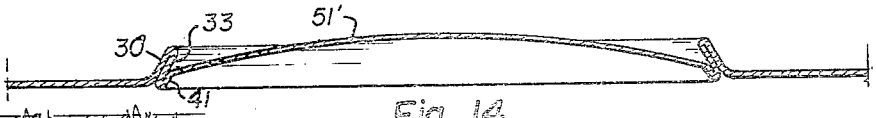
Figure 15:
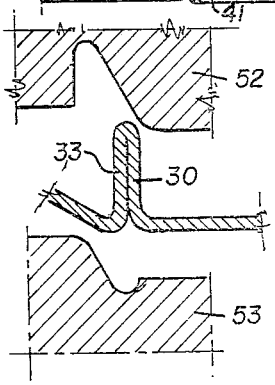
FIG. 15 is a fragmentary sectional view of a portion of the view at FIG. 13, but on an enlarged scale and illustrating further in a diagramatic manner, opposing dies which will tip the lip defining the aperture.
Figure 16:
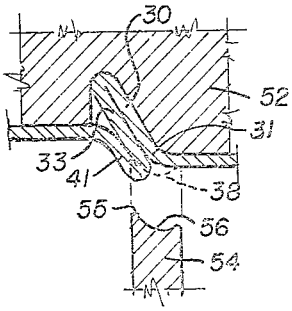
FIG. 16 is a fragmentary sectional view, similar to FIG. 15 but showing a score die positioned to cut a score line and fold the outer edge of the cut metal against the underside of the aperture.

FIG. 14 shows the lip 30 and orifice wall 33 as being tipped. Also, a return fold 41 lies against the orifice wall 33. Further steps in the operation will include shaping the gate panel in any suitable manner, cutting the score line 36 and folding the edge rim 38 against the underside of the expansion panel at the radius 31. FIGS. 15 and 16 show, in a diagrammatic manner, dies which can accomplish tipping, folding and cutting operations. In FIG. 15 an upper die 52 tips the lip 30 and orifice wall 33 while a lower die 53 will hold the end in place and at the same time form the return fold 41. FIG. 16 shows the upper die 52 in position to act as a back-up for a scoring die 54. This scoring die 54 will include a hard cutting edge 55, of carbide or like material, and a swedging face 56 to curl and shape the edge rim 38 against the panel at radius 31.

I have now described my invention in considerable detail. However, it is obvious that others skilled in the art can build and devise alternate and equivalent constructions which are nevertheless within the spirit and scope of my invention. Hence, I desire that my protection be limited not by the constructions illustrated and described, but only by the proper scope of the appended claims.

What is claimed is:

1. A push-down gate in a panel section of a can end, below an aperture therein and being connected to the panel at the aperture by a hinge means wherein:

(a) said aperture comprises a short, inwardly-inclined lip upstanding from the end panel section, having an outer wall portion upfolded from the end panel, an inner wall portion forming the aperture orifice and a reverse fold at the crest of the lip interconnecting the inner and outer wall portions;

(b) an inward fold about the base of the inner wall portion forms a gate panel below the aperture, said inward fold being on a short radius and being adjacent to the upfold radius from the end panel to the outer wall portion; and (c) a score cut in the gate panel at the inward fold extending about the panel from each side of the hinge means defines the push-down gate.

2. The push-down gate defined in claim 1, wherein an outward edge rim produced by the score cut is folded against the aforesaid upfold and against the underside of the panel adjacent to the upfold.

3. The push-down gate defined in claim 2, wherein said inward fold is a 180-degree return fold to form an upsloping rim at the edge of the gate panel, with said rim being fitted against the adjacent inner wall portion of the aperture.

4. The push-down gate defined in claim 2, wherein said hinge means comprises a short portion of uncut metal between the ends of the score cut.

5. The push-down gate defined in claim 3 wherein the gate panel includes a reverse edge turn at the crest of said 180-degree upfold to provide a finger grip or guard ridge about the gate.

6. The push-down gate defined in claim 5 wherein the reverse edge turn is a tight 180-degree fold to place a downwardly inclined finger grip or guard ridge against the said upfold, and a reverse curve fold at the base thereof to form the inner portion of the gate panel.

7. The push-down gate defined in claim 5, wherein the aperture is elongated in form.

8. The push-down gate defined in claim 2, wherein the aperture is circular in form.

9. The push-down gate defined in claim 8, wherein the aperture is at the apex of a frusto-conical end.

10. In the push-down gate defined in claim 1, wherein the reverse fold at the crest of the lip is an open fold to spread apart the tops of the inner and outer wall portions and thereby pipe the lip.

* * * * *